US006533600B1

(12) United States Patent
Kashiyama et al.

(10) Patent No.: US 6,533,600 B1
(45) Date of Patent: Mar. 18, 2003

(54) CONNECTOR FITTING CONSTRUCTION

(75) Inventors: Motohisa Kashiyama, Shizuoka (JP); Haruki Yoshida, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/385,469

(22) Filed: Aug. 30, 1999

(30) Foreign Application Priority Data

Aug. 31, 1998 (JP) ..... 10-245736

(51) Int. Cl.[7] ..... H01R 13/627
(52) U.S. Cl. ..... 439/352; 439/357
(58) Field of Search ..... 439/352, 357, 439/353, 358

(56) References Cited

U.S. PATENT DOCUMENTS

| | | | | |
|---|---|---|---|---|
| 4,915,643 A | * | 4/1990 | Samijima et al. | 439/357 |
| 5,104,253 A | * | 4/1992 | Zielinski et al. | 403/329 |
| 5,318,464 A | | 6/1994 | DiMondi et al. | 439/553 |
| 5,769,650 A | * | 6/1998 | Aoyama et al. | 439/189 |
| 5,820,399 A | | 10/1998 | Shirouzu et al. | 439/352 |

FOREIGN PATENT DOCUMENTS

| | | |
|---|---|---|
| DE | 197 33 893 | 2/1998 |
| GB | 2320624 A | 6/1998 |
| JP | 10-50408 | 2/1998 |

* cited by examiner

*Primary Examiner*—Javaid Nasri
(74) *Attorney, Agent, or Firm*—Sughrue Mion, PLLC

(57) ABSTRACT

In a connector fitting construction of the invention, a slider 60 is slidably supported within a housing 53 of a female connector 50 housing, and when the female connector is to be fitted relative to a male connector 70, the slider cooperates with compression springs 59 to flex a lock arm 56 so as to retainingly engage the lock arm with the male connector 70. A pair of abutment projections 64 are formed respectively at opposite side portions of a lower surface of a slider arm 62 provided at the slider 60. A pair of stopper projections 72 are formed on an upper surface of a housing 71 of the male connector 70, and are pressed respectively against the abutment projections 64 during a connector fitting operation to move the slider 60 toward a rear end of the female connector 50. An abutment surface 72*a* of a generally trapezoidal shape is formed on a front surface of each of the stopper projections 72. An abutment surface 64*a* of the abutment projection 64 is a slanted surface which is slanting downwardly rearwardly, and the abutment surface 72*a* of the stopper projection 72 is a slanted surface which is slanting downwardly forwardly.

4 Claims, 12 Drawing Sheets

CONNECTOR FITTING CONSTRUCTION

BACKGROUND OF INVENTION

1. Field of the Invention

This invention relates to a connector fitting construction in which a half-fitted condition is positively prevented by a resilient force of a resilient member mounted in a housing of at least one of a pair of female and male connectors to be fitted and connected together, and also the connector, fitted on the mating connector can be locked positively and easily.

2. Related Art

Usually, many electronic equipments for effecting various controls are mounted on a vehicle such as an automobile, and end portions of wires of wire harnesses are connected to the electronic equipments through various female and male connectors. In view of an assembling operation and the maintenance, the female and male connectors are so constructed as to easily connect and disconnect the wire harness.

Also, various half-fitting prevention connectors for detecting a fitted condition of the female and male connectors have been used, and for example, there is known a half-fitting prevention connector disclosed in U.S. Pat. No. 5,820,399.

This conventional half-fitting prevention connector will be described with reference to FIGS. 10 to 13.

As shown in FIG. 10, a male connector 1 (one of a pair of male and female connectors 1 and 2) comprises a housing 3, and this housing 3 includes a connector housing 3*a,* which has a terminal receiving chamber (in the form of a through hole) for receiving a predetermined number of socket contacts, and also has a terminal insertion port open to its front side, and an exclusive-use housing 3*b* provided above the connector housing 3*a* so as to slidably receive a slider 10 (described later).

The exclusive-use housing 3*b* is provided to form a slider receiving portion 4, and extends in a fitting direction, and is open upwardly. Guide grooves 5 for respectively guiding opposite side portions of a slider body 11 are formed respectively in opposite side portions of the exclusive-use housing 3*b*. A spring receiving portion 3*c* of a tubular shape is formed at a rear end of each of the guide grooves 5.

A lock arm (elastic member) 6 of the cantilever type is formed integrally with the exclusive-use housing 3*b* at a widthwise-central portion thereof, and extends in the fitting direction. A lock beak 7, having a slanting surface, is formed on an upper surface of the lock arm 6, and a housing lock 8 for retaining engagement with a female housing 21 (described later) is formed on a lower surface of the lock arm 6 at a distal end thereof. Displacement prevention projections 8*a* for preventing the displacement of the lock arm 6 are formed on the upper surface of the lock arm 6, and face away from the housing lock 8.

Side spaces 4*a* for respectively receiving abutment projections 14 of a slider arm 12 (described later) are formed at opposite sides of the lock arm 6, respectively.

The slider 10 has the elastic slider arm 12 of the cantilever type provided within the slider body 11 at a generally central portion thereof, and the pair of abutment projections 14 are formed respectively at opposite side portions of a lower surface of the slider arm 12 at a front end portion thereof. The slider 10 also includes a pressing portion 15, which is formed on an upper surface thereof at a rear end thereof, and is operated when canceling the fitting connection, and a slide groove 13 formed in the slider arm 12 and the pressing portion 15. Spring retaining portions 16 for respectively retaining compression springs 9 are formed respectively at opposite side portions of a lower portion of the slider body 11 at the rear end thereof. A displacement prevention portion 17 for preventing the displacement of the lock arm 6 is formed at the front end of the slider body 11.

The female connector (the other connector) 2 includes a terminal receiving chamber (in the form of a through hole) for receiving a predetermined number of pin contacts, and has a housing insertion port 26 open to its front side. The female connector 2 includes a pair of stopper projections 22, which are formed on an upper surface of the housing 21 so as to abut respectively against the abutment projections 14 of the slider 10 during the connector-fitting operation, a slanting projection 23, which is provided between the stopper projections 22, and has a slanting surface for flexing (elastically deforming) the lock arm 6, and an engagement groove 24 which is formed at a rear side of the slanting projection so as to be engaged with the housing lock 8.

First, the slider 10 of FIG. 10 is mounted on the male connector 1. More specifically, when the slider 10, having the compression springs 9 held respectively on the spring retaining portions 16, is pushed into the slider receiving portion 4 of the male connector 1 from the front side thereof, the slider body 11 moves rearward along the guide grooves 5. At this time, the abutment projections 14, formed respectively at the opposite side portions of the lower surface of the slider arm 12 of the slider 10, are received respectively in the side spaces 4*a* formed respectively at the opposite sides of the lock arm 6. Then, the compression springs 9 are received in the spring receiving portions 3*c,* respectively, and the lock beak 7 on the lock arm 6 is fitted in the slide groove 13 in the slider 10, so that the slider 10 is slidably mounted.

In the above condition, the slider 10 is urged forward by the resilient force of the compression springs 9, and the front end of the pressing portion 15 is retainingly held against the lock beak 7 received in the slide groove 13, and the displacement prevention projections 8*a,* formed at the distal end of the lock arm 6, abut against the displacement prevention portion 17 formed on the lower surface of the slider 10 at the front end thereof, thereby preventing the upward displacement of the lock arm 6.

Then, the socket contacts 30 (see FIG. 11), each clamped to an end portion of a wire, are inserted into the housing 3 from the rear side thereof, and are retained by housing lances formed within the terminal receiving chamber, and a double-retaining holder is attached to the housing.

The pin contacts 31 (see FIG. 11), each clamped to an end portion of a wire, are inserted into the housing 21 of the female connector 2 from the rear side thereof, and are retained by housing lances formed within the terminal receiving chamber, and a double-retaining holder is attached to the housing.

Next, the operation for fitting the male and female connectors 1 and 2 (constituting the connector fitting construction of this embodiment) together will be described.

When the operation for fitting the male and female connectors together is started as shown in FIG. 11, the stopper projections 22 of the female connector 2 are inserted respectively into the side spaces 4*a* (see FIG. 10), formed respectively at the opposite sides of the lock arm 6 of the male connector 1, and generally-vertical abutment surfaces (front surfaces) of these stopper projections 22 generally fully abut respectively against generally-vertical abutment surfaces (front surfaces) of the abutment projections 14 of the slider. From this time on, the resilient force of the compression springs 9 is produced. At this stage, the pin contacts 31, mounted in the female connector 2, are not yet fitted respectively in the socket contacts 30 mounted in the male connector 1.

Then, when the fitting operation proceeds, the slider 10 is pushed rearwardly against the bias of the compression springs 9 (see FIG. 10), so that the housing lock 8, formed at the distal end of the lock arm 6, abuts against the slanting projection 23 of the female connector 2. At this stage, the pin contacts 31 are inserted respectively into the socket contacts 30, but are not disposed in complete electrical contact therewith.

If the pushing operation is stopped in this half-fitted condition, the male and female connectors 1 and 2 are returned or moved away from each other (that is, in a disconnecting direction opposite to the fitting direction) by the resilient force of the compression springs 9, and therefore such half-fitted condition can be easily detected.

Then, when the fitting operation further proceeds, the slider arm 12 of the slider 10 is flexed (elastically deformed) upwardly by the lock beak 7, so that the abutment engagement of the stopper projections 22 with the abutment projections 14 of the slider 10 is canceled, as shown in FIG. 12. Then, the slider arm 12 slides over the stopper projections 22 under the influence of the compression springs 9, and also the housing lock 8, formed at the distal end of the lock arm 6, slides over the slanting projection 23, and is engaged in the engagement groove 24.

Then, when the slider 10 is returned to the initial position under the influence of the compression springs 9 as shown in FIG. 13, the displacement prevention portion 17 of the slider 10 abuts against the displacement prevention projections 8*a* of the lock arm 6, so that the lock arm 6 is locked, and the male and female connectors 1 and 2 are held in a completely-fitted condition, and the contacts 30 are completely connected to the contacts 31, respectively.

Therefore, in the above connector fitting construction of fitting the male and female connectors 1 and 2 together, a half-fitted condition is prevented by the resilient force of the compression springs 9, and also the fitted condition can be easily detected through the sense of touch, obtained during the fitting operation, and also by viewing the position of the slider 10.

Since the slider arm 12 is provided within the slider body 11, the slider 10 can be formed into a small size. Since the abutment projections 14 of the slider 10 are received respectively in the side spaces 4*a,* provided respectively at the opposite sides of the lock arm 6, at least the male connector 1, having the slider 10 mounted therein, can be reduced in size.

In the above construction of fitting the male and female connectors 1 and 2 together, although a half fitted condition can be prevented, the generally-vertical abutment surfaces of the stopper projections 22 of the female connector 2 generally fully abut respectively against the generally-vertical abutment surfaces of the abutment projections 14 of the slider 10, as shown in FIG. 11.

In this condition, the slider arm 12, while being flexed upwardly, slides over the abutment surfaces of the stopper projections 22 as shown in FIG. 12, and therefore the large fitting force, which also must overcome the resilient force of the compression springs 9, is required until the abutment projections 14 completely slide over the stopper projections 22, thus inviting a problem that the efficiency of the operation is prevented from being further enhanced.

And besides, when the fitting force becomes large, a large load acts on the slider arm 12 of the cantilever type, and there is a possibility that the elastic slider arm 12 is plastically deformed, thus inviting a problem that the fitting operation can not be positively effected.

Furthermore, the apex portion of each abutment projection 14, as well as the apex portion of each stopper projection 22, has an acute angle, and therefore when the fitting force becomes large, these apex portions are chipped or damaged, thus inviting a problem that the fitting connection can not be properly detected after the first fitting operation.

SUMMARY OF INVENTION

With the above problems in view, it is an object of this invention to provide a connector fitting construction in which a half-fitted condition is positively detected during a fitting connection between a pair of female and male connectors, and the two connectors can be smoothly fitted together with a relatively-low inserting force.

The above object of the present invention has been achieved by a connector fitting construction wherein a half-fitted condition of a pair of female and male connectors is prevented by a resilient force of a resilient member received in a housing of one of the two connectors:

wherein a slider is slidably supported within the housing, and when the one connector is to be fitted relative to the other connector, the slider cooperates with the resilient member to flex a lock arm of a cantilever-type, mounted on the housing, so as to retainingly engage the lock arm with the other connector; and wherein a slanting projection, having a front slanting surface, is formed on an upper surface of a housing of the other connector, and an engagement groove for engagement with an engagement projection, formed at a distal end of the lock arm, is formed at a rear end of the slanting projection; provided in that:

a pair of abutment projections are formed respectively at opposite side portions of a lower surface of an elastic arm provided at the slider;

a pair of stopper projections are formed on the upper surface of the housing of the other connector, and are pressed respectively against the abutment projections during a connector fitting operation to move the slider toward a rear end of the one connector; and an abutment surface of a generally trapezoidal shape is formed on a front surface of at least one of each abutment projection and each stopper projection.

In the above connector fitting construction, preferably, the abutment surface of the abutment projection is a slanting surface which is slanting downwardly rearwardly, and the abutment surface of the stopper projection is a slanting surface which is slanting downwardly forwardly.

In the above connector fitting construction, preferably, each of the abutment projections, as well as each of the stopper projections, has a curved surface at its apex portion.

In the above connector fitting construction of the present invention, the pair of abutment projections are formed respectively at the opposite side portions of the lower surface of the elastic arm provided at the slider, and the pair of stopper projections are formed on the upper surface of the housing of the other connector, and are pressed respectively against the abutment projections during the connector fitting operation to move the slider toward the rear end of the one connector, and the abutment surface of a generally trapezoidal shape is formed on the front surface of at least one of each abutment projection and each stopper projection.

Therefore, the abutment surface on the front surface of each stopper projection is first abutted against the abutment surface on the front surface of the associated abutment projection of the slider, and then as the abutment projection slides over the abutment surface of the stopper projection in accordance with the upward flexing of the elastic arm, the area of contact between the two decreases gradually. Therefore, a frictional force due to the sliding movement of the abutment projection over the stopper projection is reduced gradually, and the fitting force, required for fitting the female and male connectors together, can be reduced, and the fitting operation can be smoothly effected with the relatively-low inserting force.

In the case where the abutment surface of the abutment projection is the downwardly rearwardly-slanting surface while the abutment surface of the stopper projection is the downwardly forwardly-slanting surface, the load, acting on the elastic arm, can be further reduced, and therefore the deformation of the elastic arm is prevented, and the abutting engagement of the abutment projection with the stopper projection can be canceled accurately at the predetermined position.

Therefore, a half-fitted condition of the female and male connectors can be detected more positively, and the fitting force, required for the fitting operation, can be further reduced, and the fitting operation can be smoothly effected with the lower inserting force.

In the case where each abutment projection as well as each stopper projection has the curved surface at its apex portion, the apex portion will not be chipped or damaged when the abutment projection slides over the stopper projection, and even when the fitting and disconnecting operations are repeatedly effected, a half-fitted condition can be detected positively. Therefore, there can be obtained the female and male connectors which can be smoothly fitted together, and have excellent durability and reliability.

DETAILED DESCRIPTION OF PREFERRED EMBODIMENTS

Figure 1:
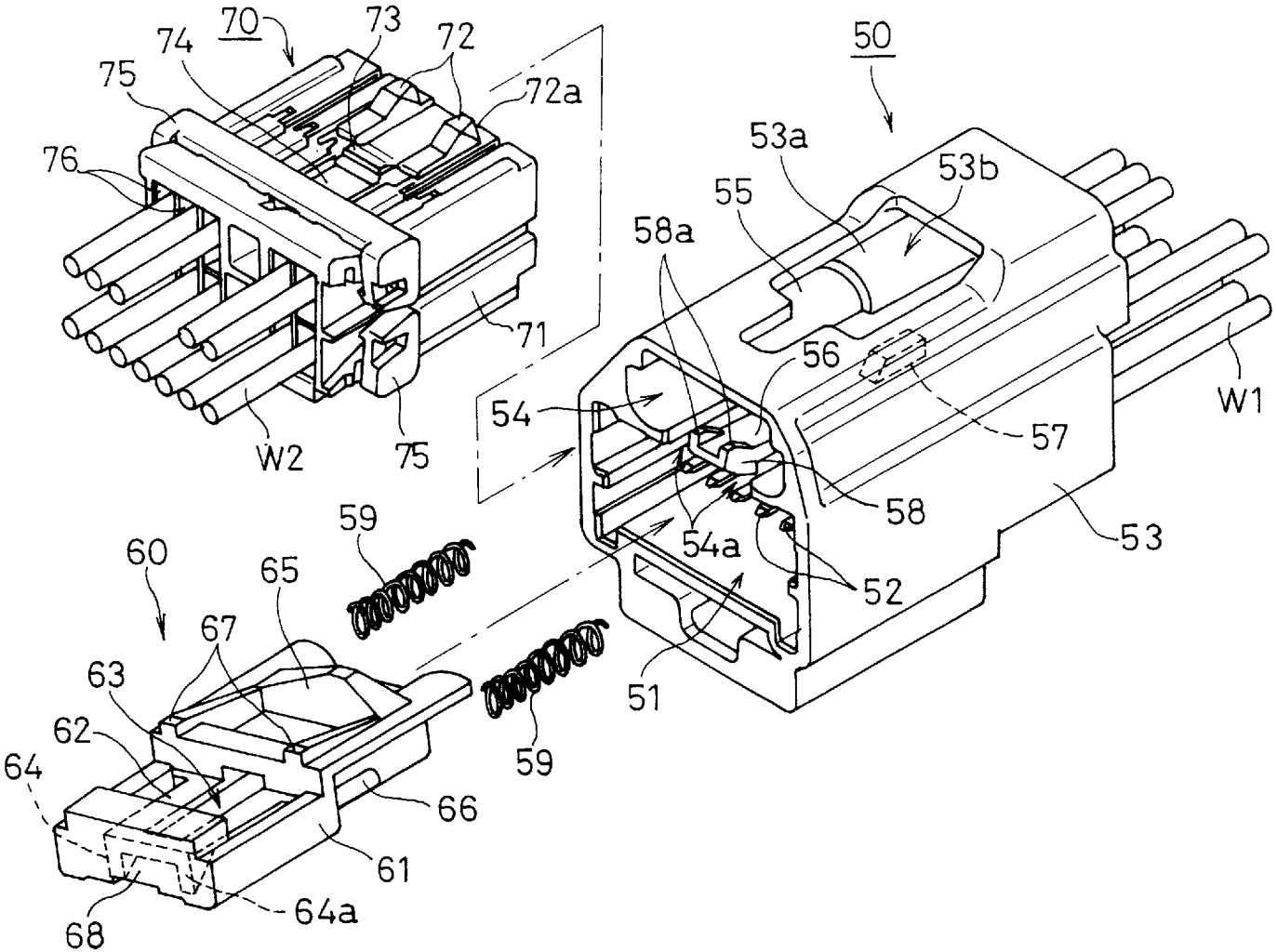
FIG. 1 is an exploded, perspective view of one preferred embodiment of a connector fitting construction of the present invention.
Figure 4:
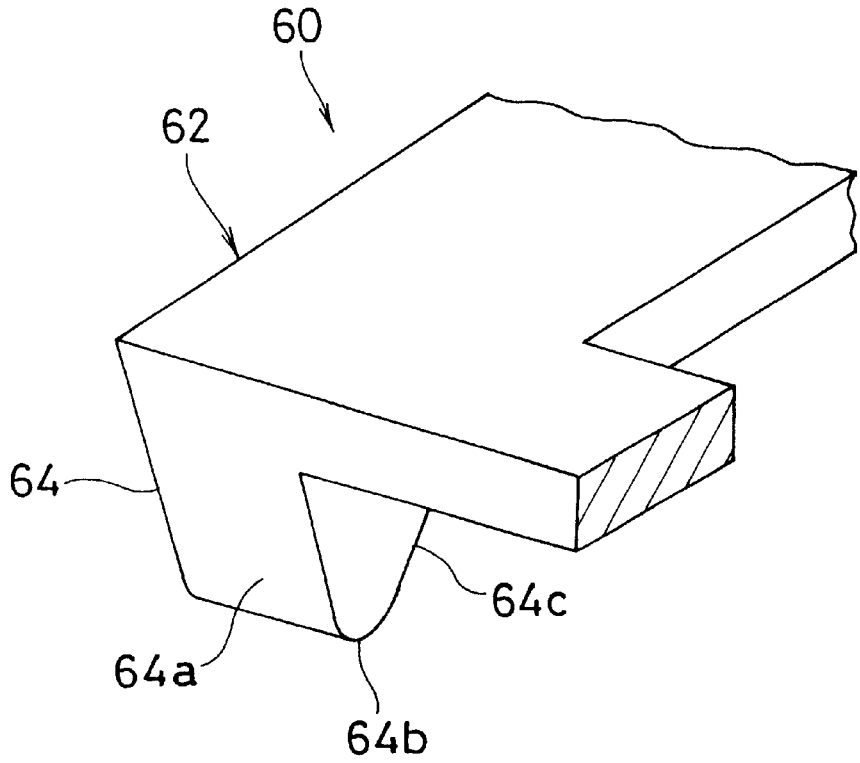
FIG. 4 is a fragmentary, perspective view showing an abutment projection of the slider of FIG. 1 on an enlarged scale.
Figure 5:
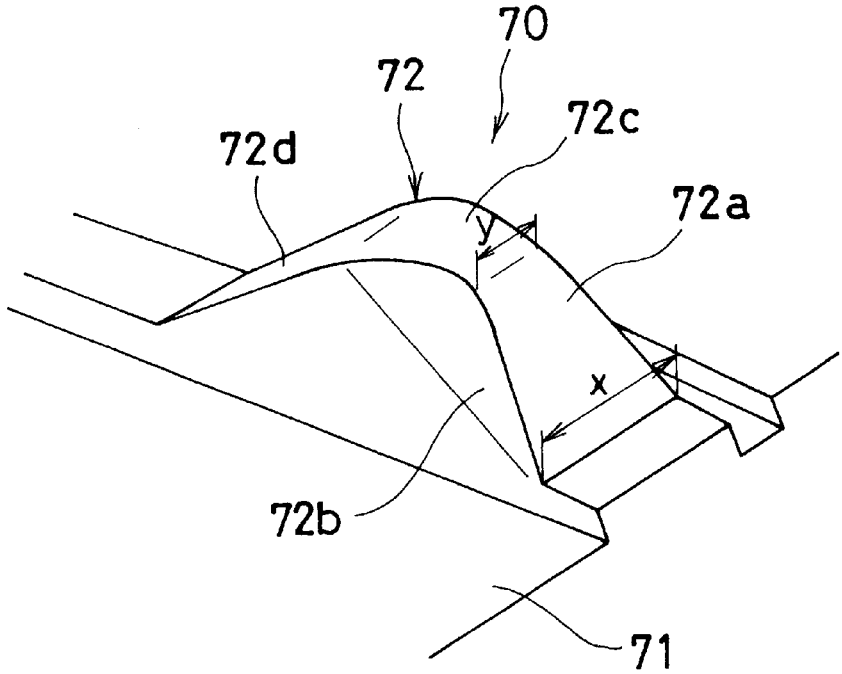
FIG. 5 is a fragmentary, perspective view showing a stopper projection of a male connector of FIG. 1.
Figure 6:
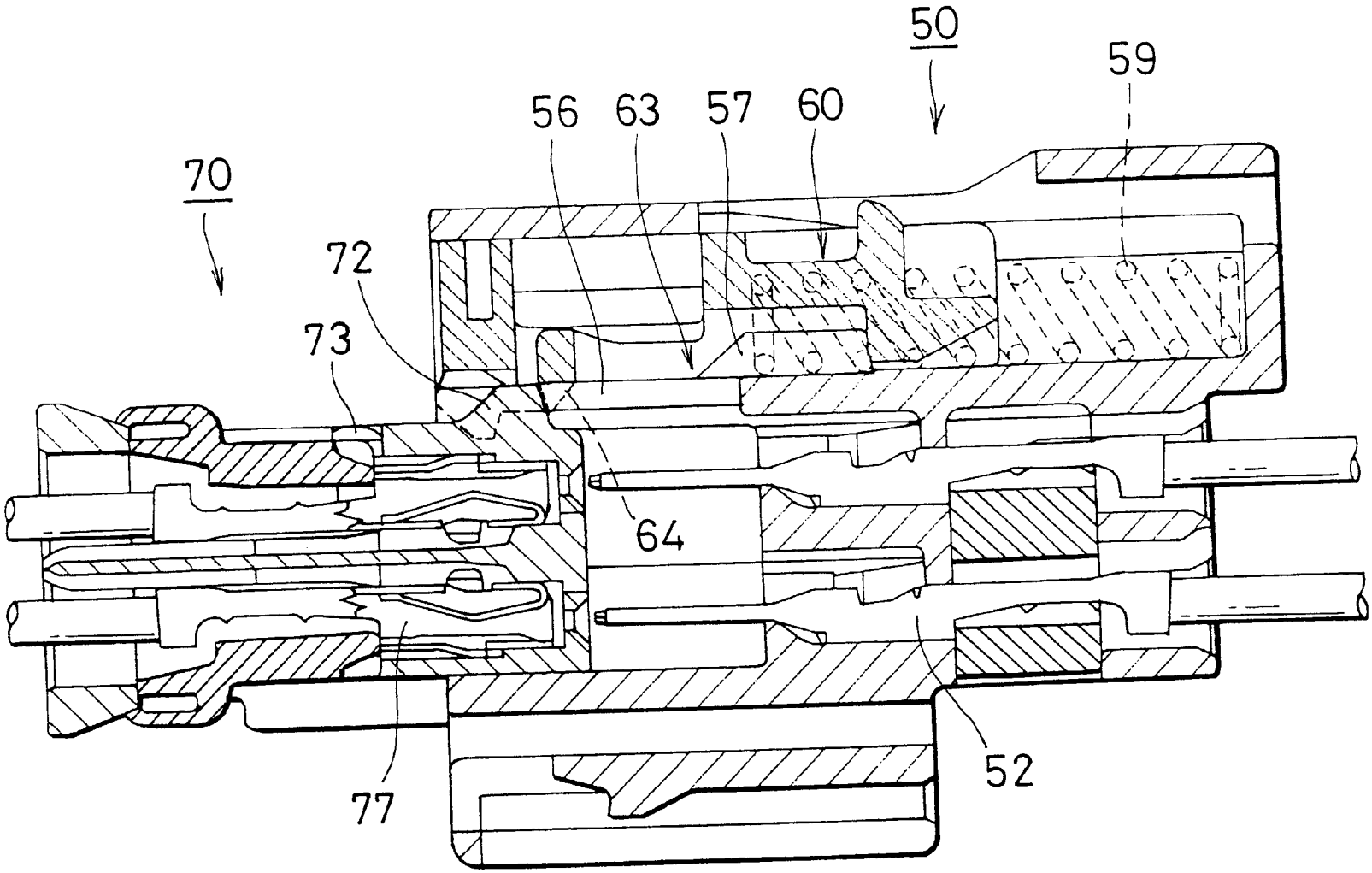
FIG. 6 is a view explanatory of an operation, showing an initially-fitted condition of the female and male connectors.
Figure 7:
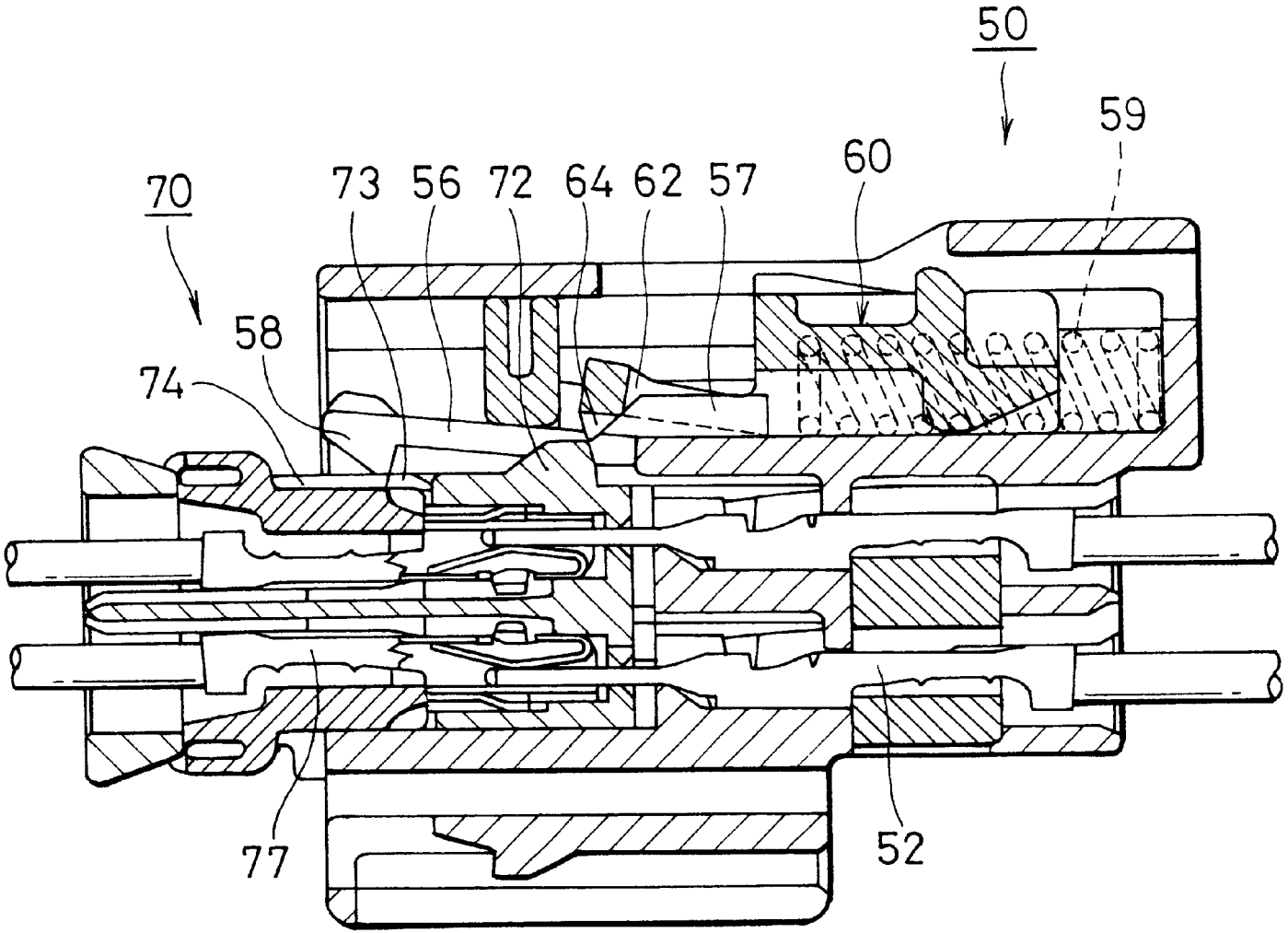
FIG. 7 is a view explanatory of the operation, showing a half-fitted condition of the connectors of FIG. 6.
Figure 8:
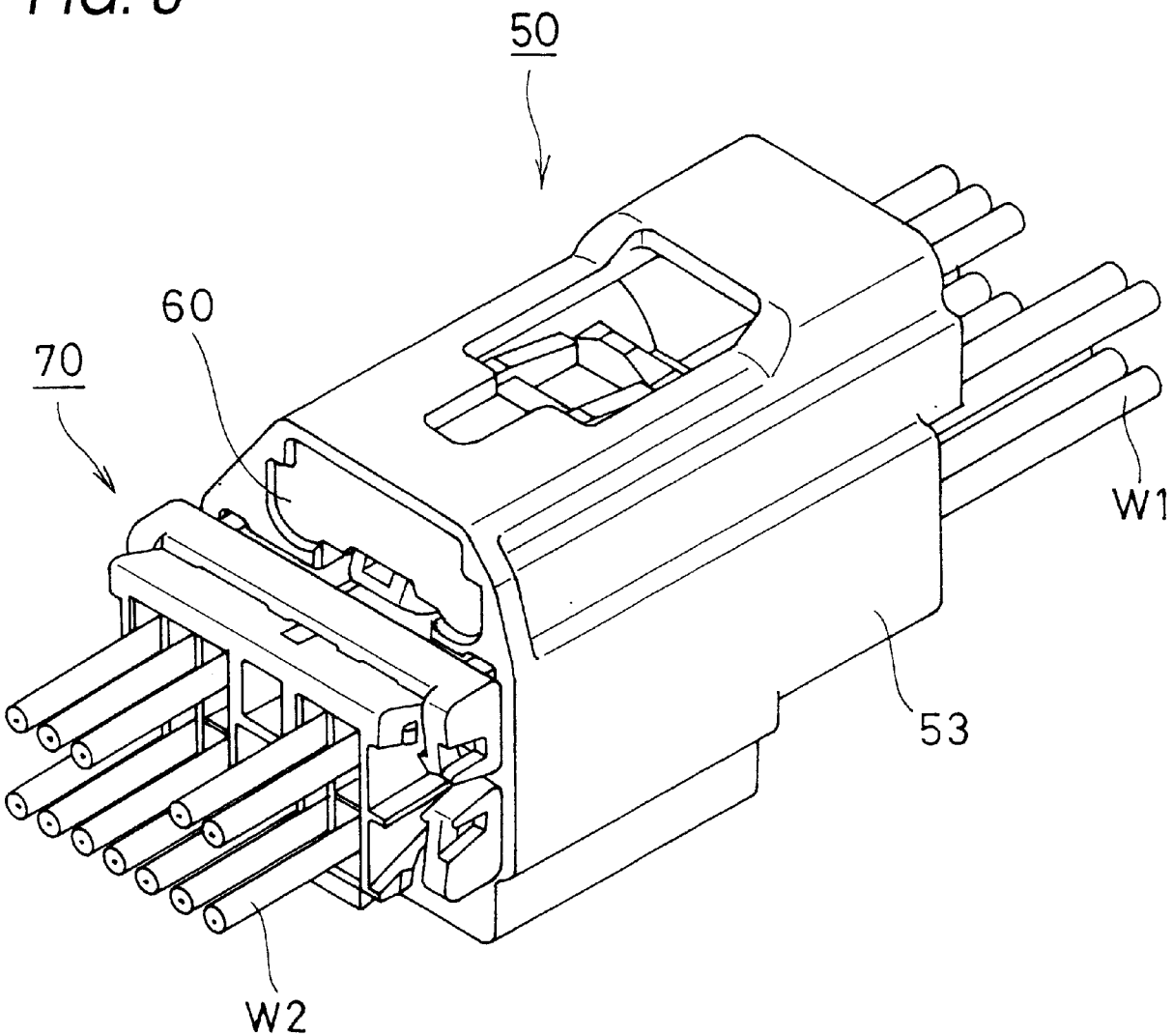
FIG. 8 is a view explanatory of the operation, showing a completely-fitted condition of the connectors of FIG. 7.
Figure 9:
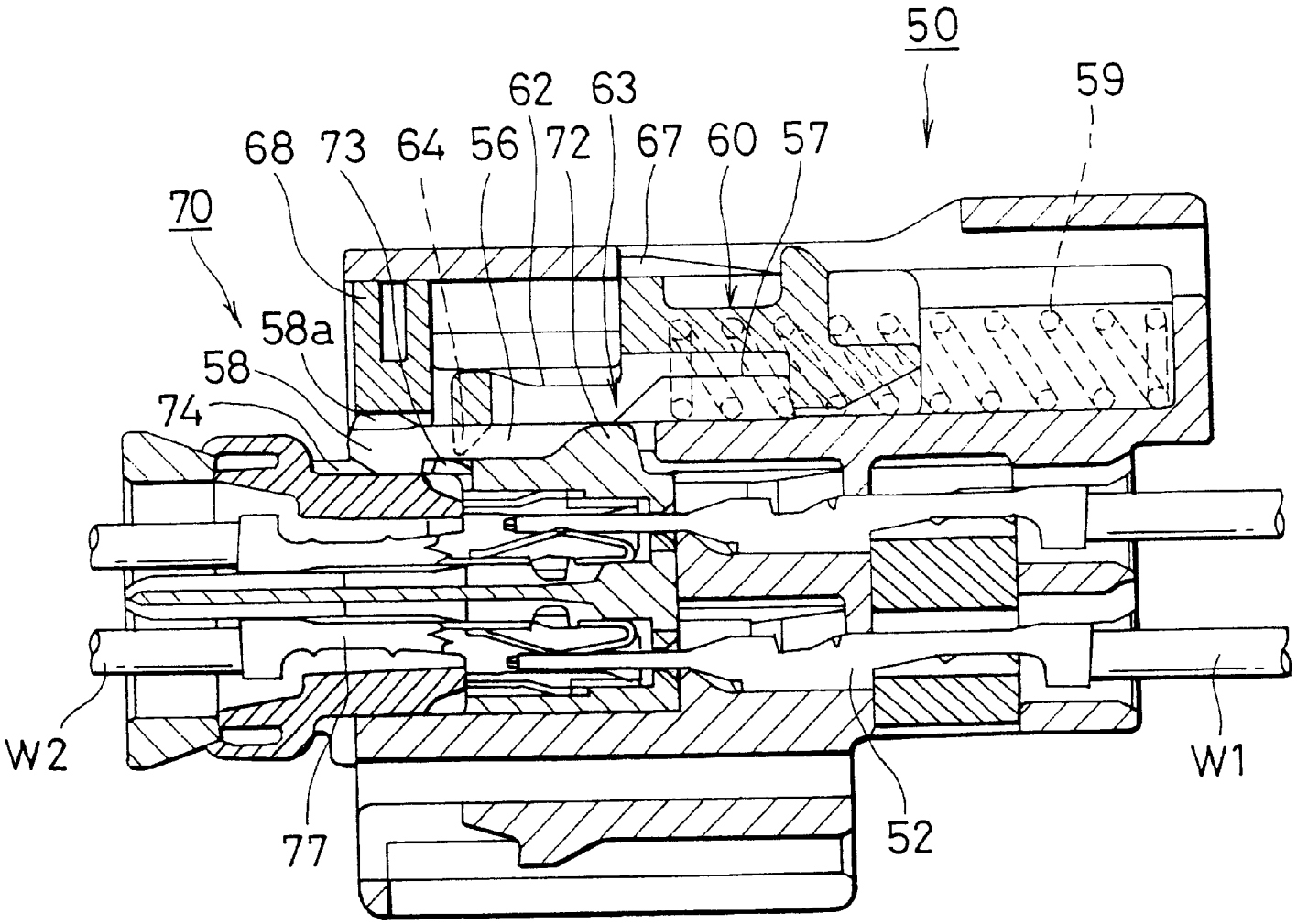
FIG. 9 is a view explanatory of the operation of FIG. 9.
Figure 10:
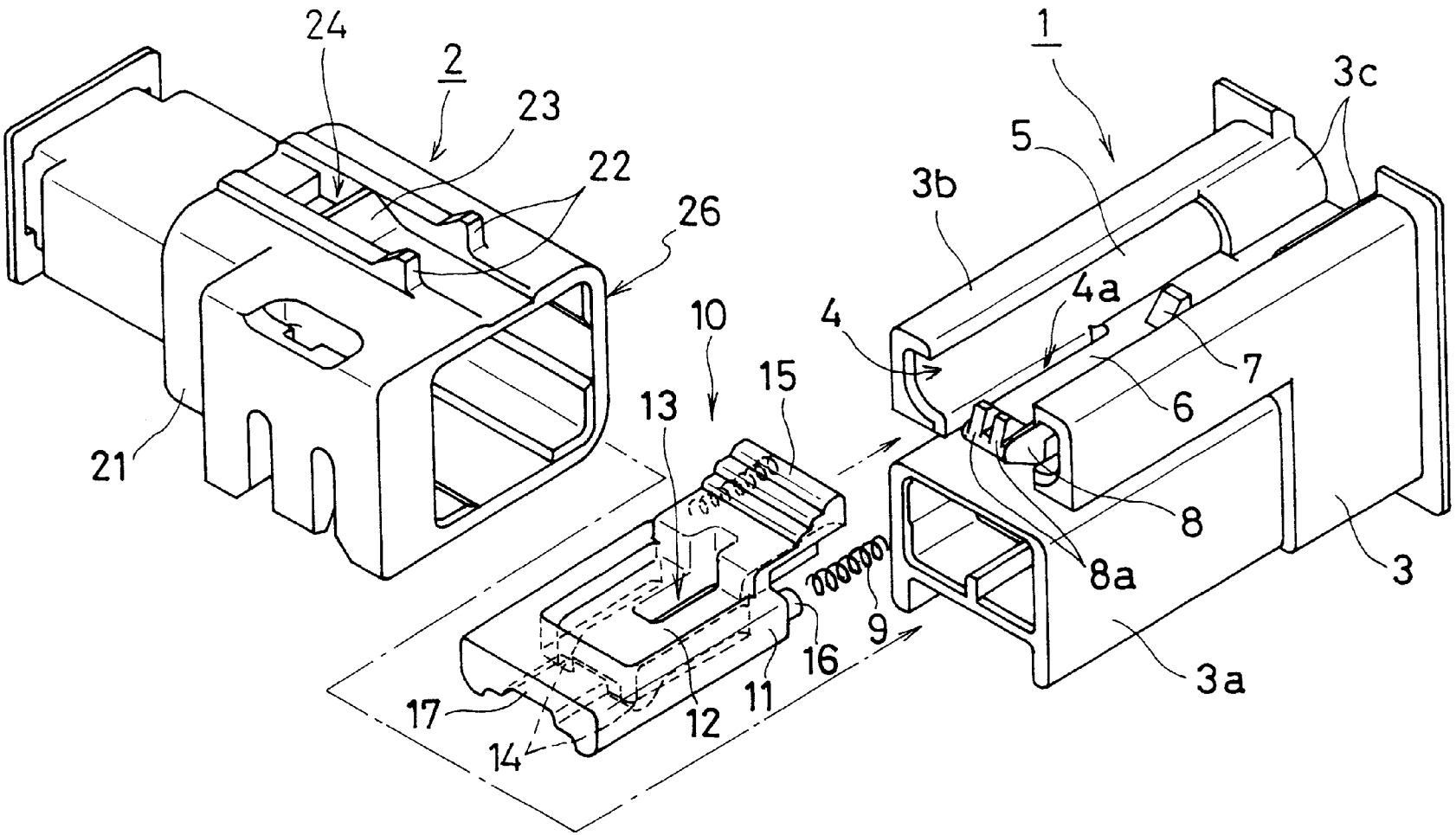
FIG. 10 PRIOR ART
FIG. 10 is an exploded, perspective view of a conventional connector fitting construction.
Figure 11:
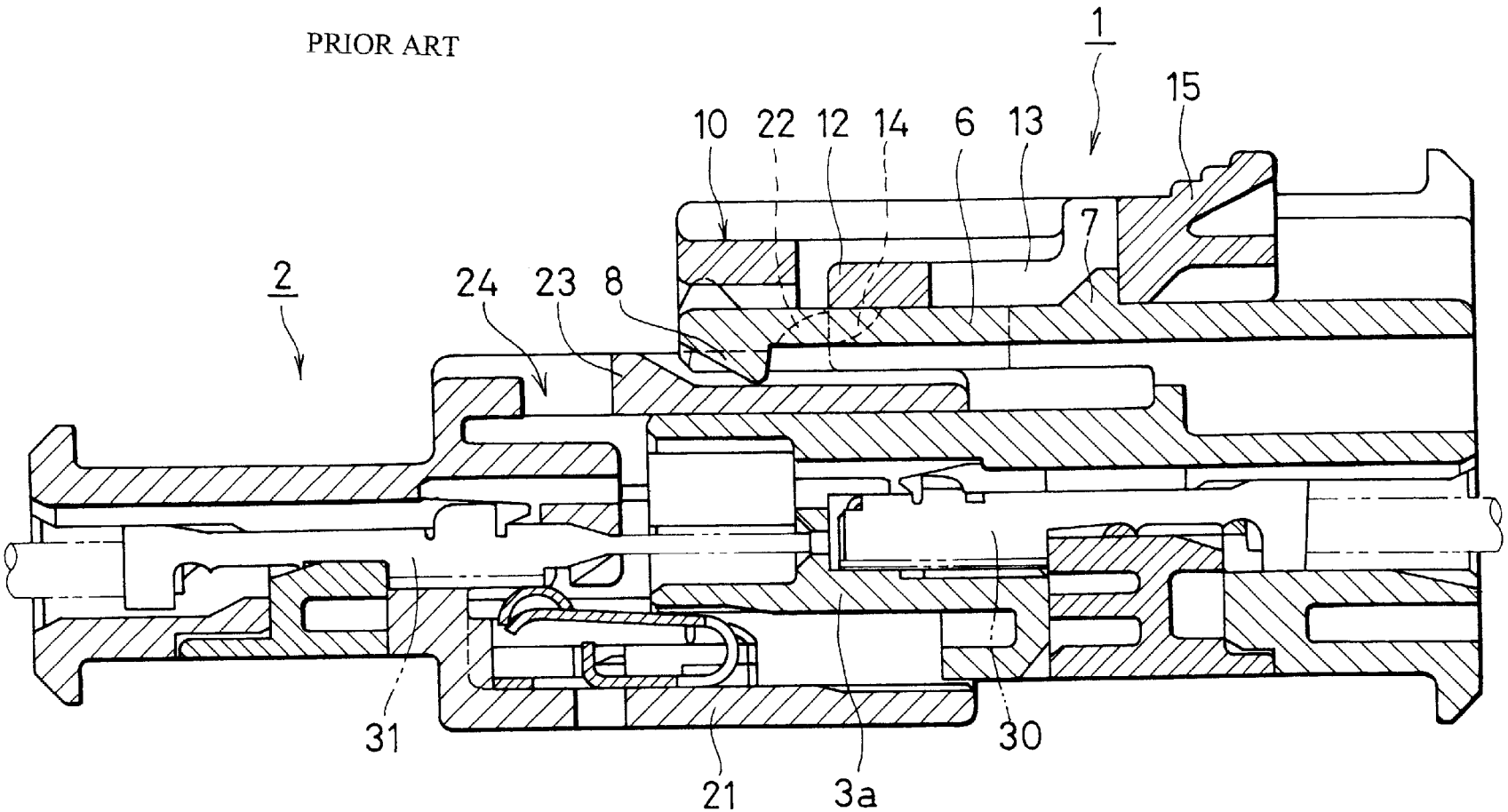
FIG. 11 PRIOR ART
FIG. 11 is a view explanatory of an operation, showing an initially-fitted condition of connectors of FIG. 10.

One preferred embodiment of a connector fitting construction of the present invention will now be described in detail with reference to FIGS. 1 to 9. FIG. 1 is an exploded, perspective view of the connector fitting construction of this embodiment, FIG. 2 is a perspective view showing a female connector having a slider mounted therein, FIG. 3 is a vertical cross-sectional view of the construction of FIG. 1, FIG. 4 is a fragmentary, perspective view showing an abutment projection of the slider of FIG. 1 on an enlarged scale, FIG. 5 is a fragmentary, perspective view showing a stopper projection of a male connector of FIG. 1, FIG. 6 is a view explanatory of an operation, showing an initially-fitted condition of the female and male connectors, FIG. 7 is a view explanatory of the operation, showing a half-fitted condition of the connectors of FIG. 6, FIG. 8 is a view explanatory of the operation, showing a completely-fitted condition of the connectors of FIG. 7, and FIG. 9 is a view explanatory of the operation of FIG. 9.

Figure 2:
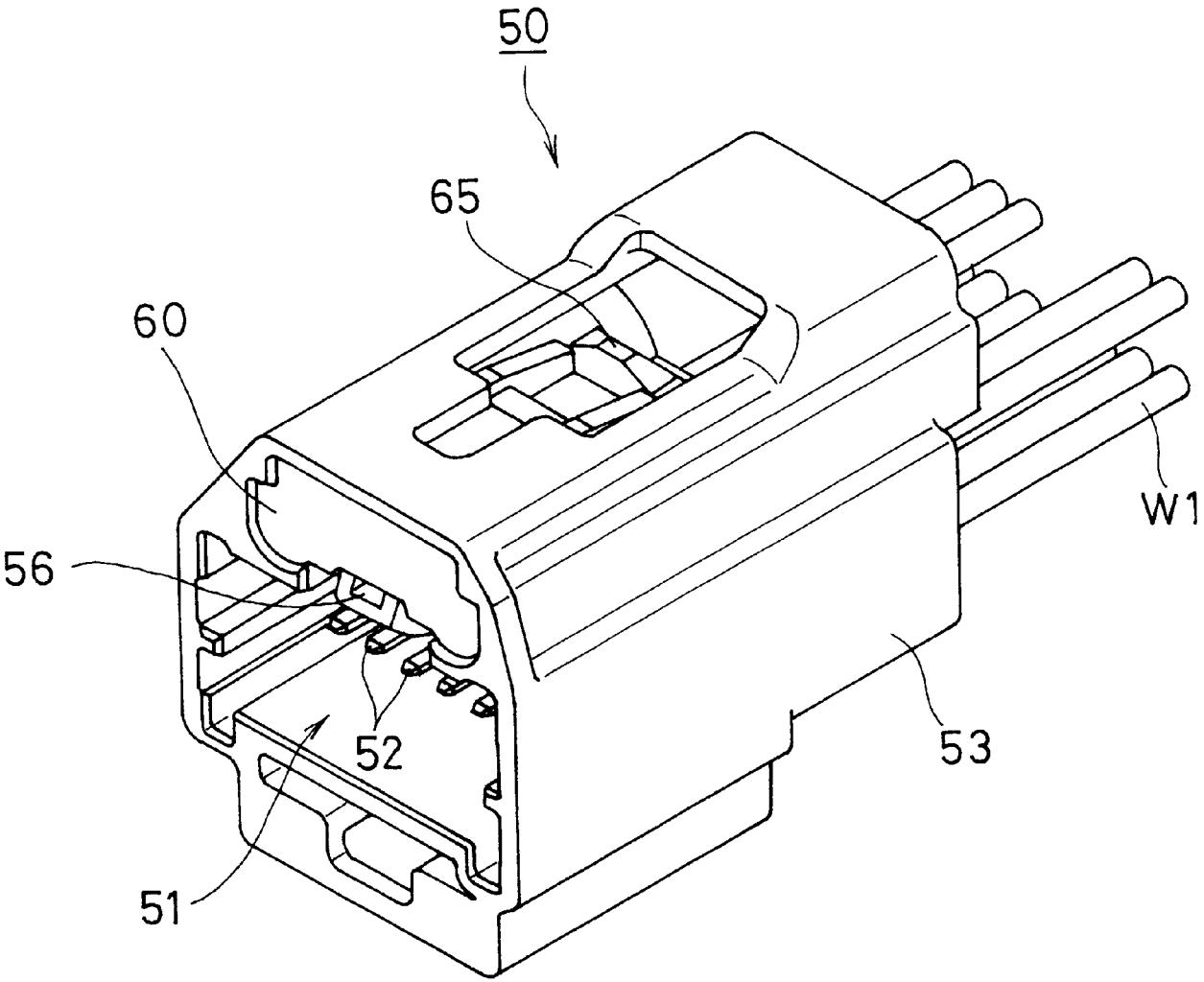
FIG. 2 is a perspective view showing a female connector of FIG. 1 having a slider mounted therein.
Figure 3:
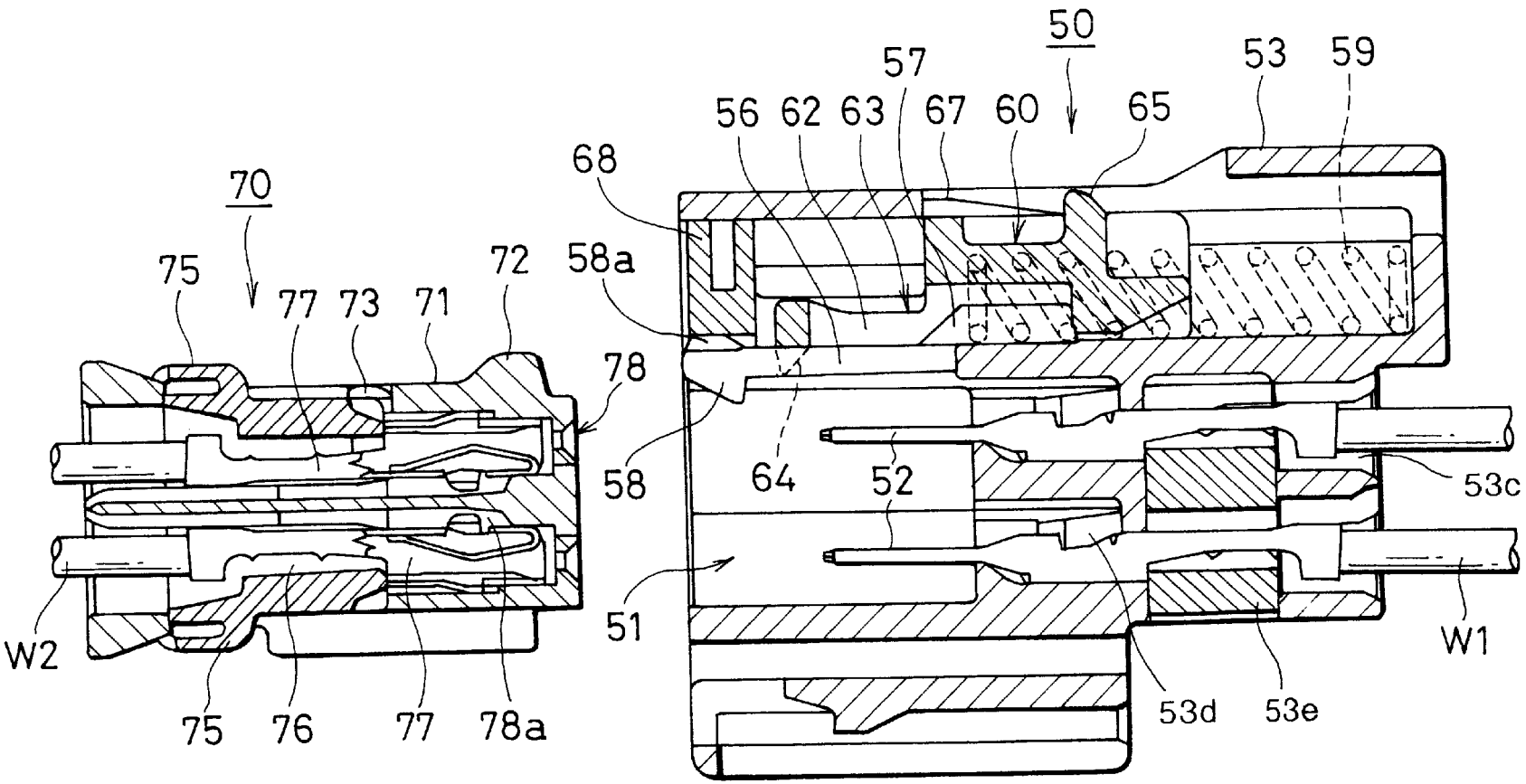
FIG. 3 is a vertical cross-sectional view of the construction of FIG. 1.

As shown in FIGS. 1 to 3, the connector fitting construction of this embodiment is directed to a construction of fitting a pair of female and male connectors 50 and 70 together. The female connector 50 (one of the two connectors) comprises a housing 53, and this housing 53 includes terminal receiving chambers 53*c* (each in the form of a through hole) for respectively receiving a predetermined number of pin contacts 52, clamped respectively to end portions of a plurality of wires W1, and a housing insertion port 51 open to its front side, and a slider receiving portion 54 for slidably receiving the slider 60 (described later).

The slider receiving portion 54 has an opening 53*b* which extends in a fitting direction, and is open upwardly. Guide grooves 55 for respectively guiding opposite side portions of a slider body 61 are formed respectively in opposite side portions of the slider receiving portion 54. A spring receiving portion 53*a* of a generally tubular shape is formed at a rear end of each of the guide grooves 55.

A lock arm 56 of the cantilever type is formed integrally with the slider receiving portion 54 at a widthwise-central portion thereof, and extends in the fitting direction. A lock beak 57, having a forwardly downwardly-slanting surface, is formed on an upper surface of the lock arm 56, and a housing lock (engagement projection) 58 for retaining engagement with a housing 71 (described later) of the male connector 70 is formed on a lower surface of the lock arm 56 at a distal end thereof.

A pair of displacement prevention projections 58*a* for preventing the displacement of the lock arm 56 are formed on the upper surface of the lock arm 56, and face away from the housing lock 58. Side spaces 54*a* for respectively receiving abutment projections 64 of a slider arm (elastic arm) 62 (described later) are formed at opposite sides of the lock arm 56, respectively.

The slider 60 has the elastic slider arm 62 of the cantilever type provided within the slider body 61 at a generally central portion thereof, and the pair of abutment projections 64 are formed respectively at opposite side portions of a lower surface of the slider arm 62 at a front end portion thereof. A slide groove (through hole) 63 for receiving the lock beak 57 is formed in a central portion of the slider arm 62 in the longitudinal direction.

The slider also includes a pressing portion 65, which is formed on an upper surface thereof at a rear end thereof, and is operated when canceling the fitting connection, and a pair of stopper ribs 67 which are formed respectively at opposite side portions of the upper surface thereof, and prevent forward withdrawal of the slider from the slider receiving portion 54. Spring retaining portions 66 for respectively retaining a pair of compression springs 59 are formed respectively at opposite side portions of a lower portion of the slider at a rear portion thereof. A displacement prevention portion 68 for preventing the displacement of the lock arm 56 is formed at the front end of the slider body 61.

As shown in FIG. 4, each of the abutment projections 64, formed at the front end of the slider arm 62 of the slider 60, includes an abutment surface 64*a,* which is slanting downwardly rearwardly, a curved surface 64*b,* defining an apex portion thereof, and a rear surface 64*c* slanting rearwardly.

The male connector (the other connector) 70 includes terminal receiving chambers 76 (each in the form of a through hole) for respectively receiving a predetermined number of socket contacts 77, clamped respectively to end portions of a plurality of wires W2, and terminal insertion ports 78 open to its front side. The male connector 70 includes a pair of stopper projections 72, which are formed on an upper surface of the housing 71 so as to abut respectively against the abutment projections 64 of the slider 60 during the connector-fitting operation, a slanting projection 73, which is provided between the stopper projections 72, and has a slanting surface for flexing (elastically deforming) the lock arm 56, and an engagement groove 74 which is formed at a rear side of the slanting projection 73 so as to be engaged with the housing lock 58. A pair of holders 75 for preventing rearward withdrawal of the socket contacts 77 are attached to the housing 71 from the upper and lower sides thereof.

As shown in FIG. 5, each of the stopper projections 72 on the male connector includes an abutment surface (front surface) 72*a,* slanting downwardly forwardly, slanting side surfaces 72*b,* formed respectively on opposite side surfaces thereof, a curved surface 72*c,* defining an apex portion thereof, and a rear surface 72*d* slanting rearwardly. When viewed from the front side, the stopper projection 72 has a generally trapezoidal shape, and a width y of its apex portion is smaller than a width x of its proximal end portion.

Next, the procedure of fitting the above female and male connectors 50 and 70 together will be described.

First, the slider 60 is mounted on the female connector 50 as shown in FIGS. 1 to 3. More specifically, when the slider 60, having the two compression springs 59 held respectively on the spring retaining portions 66, is pushed into the slider receiving portion 54 of the female connector 50 from the front side thereof, the slider body 61 moves rearward along the guide grooves 55.

At this time, the abutment projections 64, formed respectively at the opposite side portions of the lower surface of the slider arm 62 of the slider 60, are received respectively in the side spaces 54*a* formed respectively at the opposite sides of the lock arm 56. Then, the compression springs 59 are received in the spring receiving portions 53*a,* respectively, and the lock beak 57 on the lock arm 56 is fitted in the slide groove 63 in the slider 60, so that the slider 60 is slidably mounted.

In this mounted condition, the slider 60 is urged forward by the resilient force of the compression springs 59 as shown in FIG. 3, and the front ends of the stopper ribs 67 are held against the front edge of the opening 53*b* in the upper wall of the housing 53, and the displacement prevention projections 58*a,* formed at the distal end of the lock arm 56, abut against the displacement prevention portion 68 formed at the front end of the slider 60, thereby preventing the upward displacement of the lock arm 56.

Then, the pin contacts 52, clamped respectively to the end portions of the wires W1, are inserted respectively into the terminal receiving chambers 53*c* from the rear side of the housing 53, and are retained by housing lances 53*d,* and a double-retaining holder 53*e* is attached to the housing.

Then, the socket contacts 77, clamped respectively to the end portions of the wires W2, are inserted respectively into the terminal receiving chambers 76 from the rear side of the housing 71 of the male connector 70, and are retained by housing lances 78*a,* and the double-retaining holders 75 are attached to the housing.

Next, the operation for fitting the female and male connectors 50 and 70 (constituting the connector fitting construction of this embodiment) together will be described.

When the operation for fitting the female and male connectors 50 and 70 together is started as shown in FIG. 6, the stopper projections 72 of the male connector 70 are inserted respectively into the side spaces 54*a* (see FIG. 1), formed respectively at the opposite sides of the lock arm 56 of the female connector 50, and these stopper projections 72 abut respectively against the abutment projections 64 of the slider 60. From this time on, the compression springs 59 are compressed to produce a resilient force. At this stage, the pin contacts 52, mounted in the female connector 50, are not yet fitted respectively in the socket contacts 77 mounted in the male connector 70.

Then, when the fitting operation further proceeds, the slider 60 is pushed rearwardly against the bias of the compression springs 59, so that the housing lock 58, formed at the distal end of the lock arm 56, abuts against the slanting projection 73 of the male connector 70, as shown in FIG. 7.

If the pushing operation is stopped in this half-fitted condition, the female and male connectors 50 and 70 are returned or moved away from each other (that is, in a disconnecting direction opposite to the fitting direction) by the resilient force of the compression springs 59, and therefore such half-fitted condition can be easily detected.

Figure 12:
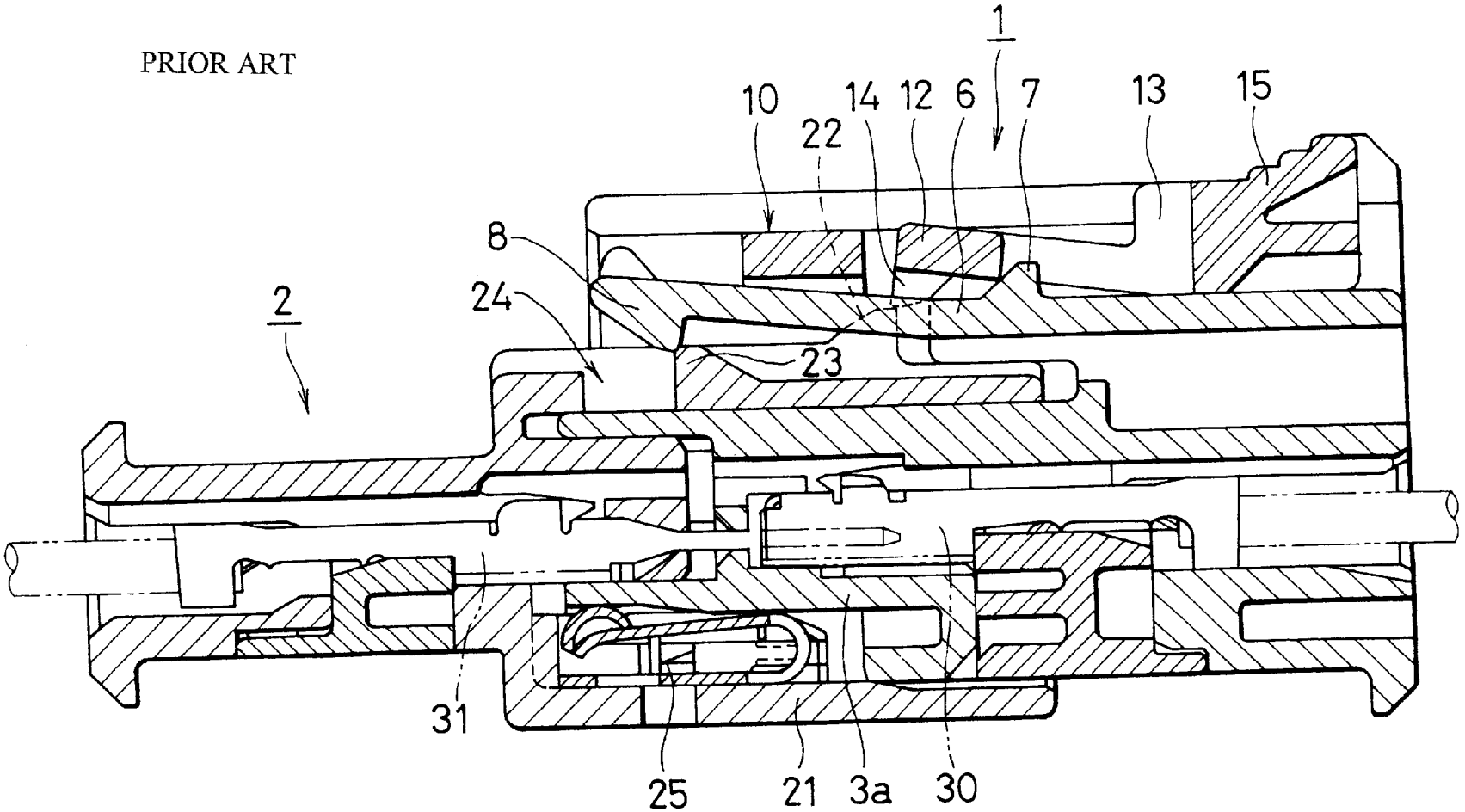
FIG. 12 PRIOR ART
FIG. 12 is a view explanatory of the operation, showing a half-fitted condition of the connectors of FIG. 11.
Figure 13:
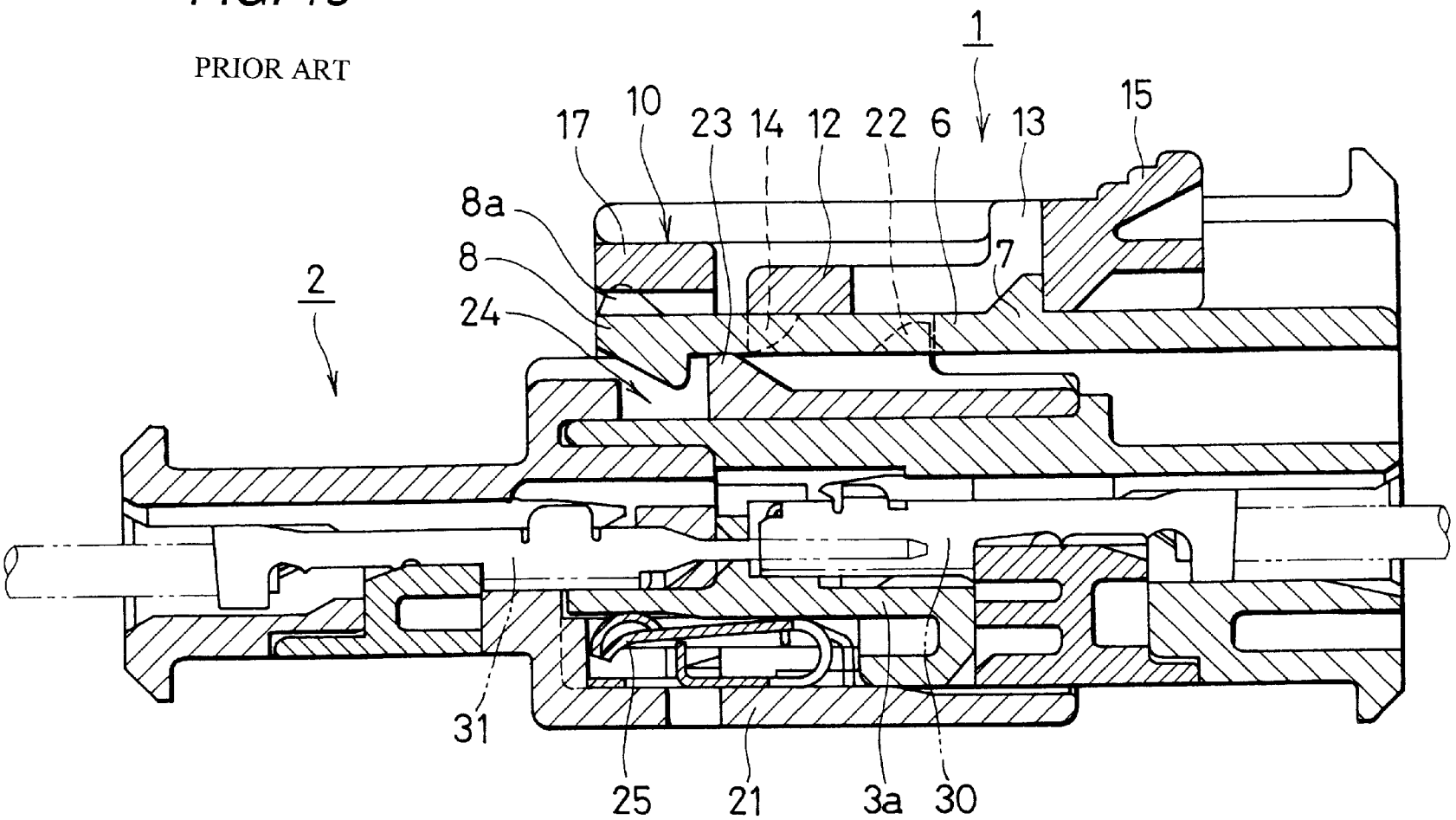
FIG. 13 PRIOR ART
FIG. 13 is a view explanatory of the operation, showing a completely-fitted condition of the connectors of FIG. 12.

Then, when the fitting operation further proceeds, the slider arm 62 of the slider 60 is flexed (elastically deformed) upwardly by the lock beak 57, so that the abutment engagement of the stopper projections 72 with the abutment projections 64 of the slider 60 is canceled, as shown in FIG. 12. Also, the housing lock 58 at the front end of the lock arm 56 slides over the slanting projection 73, and begins to drop into the engagement groove 74.

At this time, as shown in FIGS. 4 and 5, the abutment surface (downwardly rearwardly-slanting front surface) 64*a* of each abutment projection 64 of the slider 60, abutted against the abutment surface (downwardly forwardly-slanting front surface) 72*a* of the associated stopper projection 72, slides over the abutment surface 72*a* of the stopper projection 72 in accordance with the upward flexing of the slider arm 62.

The stopper projection 72 has a generally trapezoidal shape such that the width of the stopper projection 72 is decreasing progressively from its proximal end (having the width x) toward its apex portion (having the width y). Therefore, as the abutment projection 64 moves upward, the area of contact between the stopper projection 72 and the abutment projection 64 gradually decreases. Therefore, a frictional force due to the sliding movement of the abutment projection 64 over the stopper projection 72 gradually decreases, so that the fitting force, required for fitting the female and male connectors 50 and 70 together, is reduced, and the fitting operation can be smoothly effected with a relatively-low inserting force.

And besides, since a stress load, acting on the slider arm 62, is reduced, the deformation of the slider arm 62 is prevented, and the abutting engagement of the abutment projections 64 with the stopper projections 72 can be canceled accurately at the predetermined position. Therefore, a half-fitted condition of the female and male connectors 50 and 70 can be detected more positively.

The abutment projection 64 has the curved surface 64*b* at its apex portion, and the stopper projection 72 has the curved surface 72*c* at its apex portion. Therefore, when the abutment projection 64 slides over the stopper projection 72, these apex portions will not be chipped or damaged, and even when the fitting and disconnecting operations are effected repeatedly, a half-fitted condition can be positively detected. Therefore, there can be obtained the female and male connectors which can be smoothly fitted together, and have excellent durability and reliability.

Then, as shown in FIGS. 8 and 9, under the influence of he compression springs 59, the slider arm 62 slides over the stopper projections 72, and the housing lock 58 is engaged in the engagement groove 74.

When the slider 60 is returned to the initial position under the influence of the compression springs 59, the displacement prevention portion 68 of the slider 60 abuts against the displacement prevention projections 58*a* of the lock arm 56, so that the lock arm 56 is locked, and the female and male connectors 50 and 70 are held in a completely-fitted condition, and the pin contacts 52 are completely electrically connected to the socket contacts 77, respectively.

This completely-fitted condition can be detected through the sense of touch, obtained when the housing lock 58 of the lock arm 56 slides over the slanting projection 73, and also can be easily detected by viewing the position of the returned slider 60 with the eyes.

Next, the procedure of canceling the completely-fitted condition will be described.

The pressing portion 65 of the slider 60, shown in FIG. 9, is held with the fingers from the upper side, and the slider is slid rearwardly (in a right-hand direction in FIG. 9) against the bias of the compression springs 59. As a result, the displacement prevention portion 68 of the slider 60, locking the lock arm 56, is moved, thereby canceling this locked condition.

Then, the slider arm 62 of the slider 60 is flexed upwardly by the slanting surface of the lock beak 57, so that the free end portion of the lock arm 56 can be displaced, as shown in FIG. 7. Therefore, a disconnecting force is applied so as to disconnect the two connectors from each other, and by doing so, the housing lock 58 (formed at the distal end of the lock arm 56), engaged in the engagement groove 74, is flexed upwardly to be disengaged from this engagement groove. In this condition, the male connector 70 is held with the hand, and is pulled rearwardly, and by doing so, the male connector can be easily disconnected from the female connector 50.

As described above, in the connector fitting construction of this embodiment, the pair of abutment projections 64 are formed respectively at the opposite side portions of the lower surface of the slider arm 62 provided at the slider 60 received within the female connector 50. The pair of stopper projections 72 are formed on the upper surface of the housing 71, and are pressed respectively against the abutment projections 64 during the connector-fitting operation to move the slider 60 toward the rear end of the female connector 50. Each abutment projection 64 has the abutment surface (slanting surface) 64*a* formed at the front end thereof, and each stopper projection 72 has the abutment surface (slanting surface) 72*a* formed at the front end thereof, and the abutment surface 72*a* has a generally trapezoidal shape.

Therefore, as each abutment projection 64 slides over the abutment surface 72*a* of the associated stopper projection 72 in accordance with the upward flexing of the slider arm 62, the area of contact between the two decreases gradually, so that the frictional force due to the sliding movement of the abutment projection 64 is reduced. Therefore, the fitting force, required for fitting the female and male connectors together, can be reduced, and the fitting operation can be smoothly effected with the relatively-low inserting force.

The connector fitting construction of the present invention is not limited to the above embodiment, and can be applied to other embodiments. Namely, although this embodiment is directed to the non-waterproof-type connector fitting construction, the invention can be applied to a waterproof-type connector fitting construction. In this embodiment, although the slider receiving portion is provided at the female connector while the stopper projections are provided at the male connector, there can be provided a connector fitting construction of a reverse design in which a slider receiving portion is provided at a male connector while stopper projections are provided at a female connector.

As described above, in the connector fitting construction of the present invention, the pair of abutment projections are formed respectively at the opposite side portions of the lower surface of the elastic arm provided at the slider, and the pair of stopper projections are formed on the upper surface of the housing of the other connector, and are pressed respectively against the abutment projections during the connector fitting operation to move the slider toward the rear end of the one connector, and the abutment surface of a generally trapezoidal shape is formed on the front surface of at least one of each abutment projection and each stopper projection.

Therefore, as the abutment projection slides over the abutment surface of the stopper projection during the fitting operation in accordance with the upward flexing of the elastic arm, the area of contact between the two decreases gradually, and therefore, the frictional force due to the sliding movement of the abutment projection over the stopper projection is reduced gradually. Therefore, the fitting force, required for fitting the female and male connectors together, can be reduced, and the fitting operation can be smoothly effected with the relatively-low inserting force.

In the case where the abutment surface of the abutment projection is the downwardly rearwardly-slanting surface while the abutment surface of the stopper projection is the downwardly forwardly-slanting surface, the load, acting on the elastic arm, can be further reduced, and therefore the deformation of the elastic arm is prevented, and the abutting engagement of the abutment projection with the stopper projection can be canceled accurately at the predetermined position.

Therefore, a half-fitted condition of the female and male connectors can be detected more positively, and the fitting force, required for the fitting operation, can be further reduced, and the fitting operation can be smoothly effected with the lower inserting force.

In the case where each abutment projection as well as each stopper projection has the curved surface at its apex portion, the apex portion will not be chipped or damaged when the abutment projection slides over the stopper projection, and even when the fitting and disconnecting operations are repeatedly effected, a half-fitted condition can be detected positively. Therefore, there can be obtained the female and male connectors which can be smoothly fitted together, and have excellent durability and reliability.

What is claimed is:

1. A connector fitting construction comprising:

a pair of female and male connectors fitted together;

a resilient member, received in a housing of one of said two connectors, for applying a resilient force thereof to at least one of said pair of said female and male connectors to avoid a half-fitted condition of said pair of female and male connectors;

a slider slidably supported within said housing, and when said one connector is fitted relative to the other connector, said slider cooperates with said resilient member to flex a lock arm of a cantilever-type, mounted on said housing, operable to retainingly engage said lock arm with said other connector; and a slanting projection, having a front slanting surface, formed on an upper surface of a housing of said other connector;

an engagement groove for engagement with an engagement projection, formed at a distal end of said lock arm, said engagement groove being formed at a rear end of said slanting projection;

a pair of abutment projections formed respectively at opposite side portions of a lower surface of an elastic arm provided at said slider;

a pair of stopper projections formed on the upper surface of said housing of said other connector, and pressed respectively against said abutment projections during a connector fitting operation to move said slider toward a rear end of said one connector; and an abutment surface of a generally trapezoidal shape formed on a front surface of at least one of each abutment projection and each stopper projection.

2. A connector fitting construction according to claim 1, wherein the abutment surface of said abutment projection is a slanting surface which is slanted downwardly, rearwardly, and the abutment surface of said stopper projection is a slanting surface which is slanted downwardly, forwardly.

3. A connector fitting construction according to claim 2, wherein each of said abutment projections has a curved surface at its apex portion, and each of said stopper projections has a curved surface at its apex portion.

4. A connector fitting construction according to claim 1, wherein each of said abutment projections has a curved surface at its apex portion, and each of said stopper projections has a curved surface at its apex portion.

* * * * *